United States Patent [19]

Burkert et al.

[11] 4,178,266

[45] Dec. 11, 1979

[54] PROCESS FOR CONVEYING HOT CRUDE COKE OVEN GAS FROM COKE OVENS TO A POSITION OF UTILIZATION WHILE PREVENTING CONDENSATION OF HIGHER HYDROCARBONS

[75] Inventors: Rudolf Burkert; Claus Flockenhaus, both of Essen; Joachim F. Meckel, Heiligenhaus; Dietrich Wagener, Essen, all of Fed. Rep. of Germany

[73] Assignee: Didier Engineering GmbH, Essen, Fed. Rep. of Germany

[21] Appl. No.: 865,723

[22] Filed: Dec. 29, 1977

[30] Foreign Application Priority Data

Jan. 3, 1977 [DE] Fed. Rep. of Germany ..... 2700044

[51] Int. Cl.[2] ..... C01B 2/02

[52] U.S. Cl. ..... 252/373; 48/190; 48/197 R; 201/41

[58] Field of Search ..... 48/197 R, 190; 252/373, 252/372; 201/41; 75/34, 35, 91

[56] References Cited

U.S. PATENT DOCUMENTS

| | | | |
|---|---|---|---|
| 1,945,001 | 1/1934 | Shively | 48/190 |
| 2,047,499 | 7/1936 | Towne | 48/197 R |
| 2,192,011 | 2/1940 | Koller | 48/190 |
| 2,375,500 | 5/1945 | Silver et al. | 48/190 |
| 2,951,749 | 9/1960 | Bartholome et al. | 48/197 R |
| 3,767,379 | 10/1973 | Marion | 252/373 |
| 4,082,520 | 4/1978 | Baron et al. | 48/197 R |

FOREIGN PATENT DOCUMENTS

| | | | |
|---|---|---|---|
| 961341 | 6/1964 | United Kingdom | 48/197 R |

*Primary Examiner*—S. Leon Bashore
*Assistant Examiner*—Peter F. Kratz
*Attorney, Agent, or Firm*—Wenderoth, Lind & Ponack

[57] ABSTRACT

As hot crude coke oven gas is conveyed from coke ovens to a position of utilization, condensation of higher hydrocarbons from the coke oven gas is prevented by increasing the temperature of the coke oven gas to a temperature such that higher hydrocarbons are prevented from condensing therefrom. This increase in temperature may be achieved by injecting oxygen-containing gas into the hot crude coke oven gas, to thereby produce a partial combustion of the coke oven gas. Alternatively, when the coke oven gas is being conveyed to a thermal cracking reactor wherein the coke oven gas is thermally cracked to form a cracked gas, the temperature of the coke oven gas may be increased by passing the coke oven gas through a heat exchanger in indirect heat exchange relation with the cracked gas.

7 Claims, 4 Drawing Figures

PROCESS FOR CONVEYING HOT CRUDE COKE OVEN GAS FROM COKE OVENS TO A POSITION OF UTILIZATION WHILE PREVENTING CONDENSATION OF HIGHER HYDROCARBONS

BACKGROUND OF THE INVENTION

The present invention relates to a process for preventing the condensation of higher hydrocarbons from hot crude coke oven gas during the conveyance of the coke oven gas from coke ovens to a position of utilization.

The present invention is particularly related to such a process which is employable in conjunction with a process disclosed in German patent application No. P 2,638,348, corresponding to U.S. application Ser. No. 827,809, filed Aug. 25, 1977, wherein hot crude coke oven gas is subjected to a thermal cracking operation by passing the coke oven gas into a thermal cracking reactor and injecting thereinto an $O_2$-containing gas, thereby producing a partial combustion of the coke oven gas, with the result that the coke oven gas is cracked.

In such process, the coke oven gas is subjected to a thermal cracking operation without any preliminary cooling or purification operations. Accordingly, it will be apparent that it is of great importance to avoid any condensation of impurities from the coke oven gas prior to entry of the coke oven gas into the thermal cracking reactor.

It will also be apparent that condensation of impurities from a coke oven gas is disadvantageous in any system wherein the coke oven gas is conveyed to a position of utilization.

The temperature of coke oven gas as it leaves the coke ovens is approximately 750° C., and it is possible for higher hydrocarbons to condense out at this temperature. Further, as the coke oven gas is conveyed over relatively long conveyance paths to a position of utilization, the temperature of the coke oven gas will normally be reduced, thereby allowing for the further condensation of additional higher hydrocarbons.

SUMMARY OF THE INVENTION

With the above discussion in mind, it is the primary object of the present invention to provide a process for preventing condensation of higher hydrocarbons from hot crude coke oven gas during the conveyance of the coke oven gas from coke ovens to a position of utilization.

It is a further and particular object of the present invention to provide such a process which is usable in conjunction with the process of the above-noted German patent application, wherein coke oven gas is, after discharge thereof from coke ovens, subjected to a thermal cracking operation without any preliminary cooling and purification operations.

These objects are achieved in accordance with the present invention by increasing the temperature of the hot crude coke oven gas to a temperature such that higher hydrocarbons are prevented from condensing therefrom.

In accordance with one embodiment of the present invention, the temperature of the coke oven gas is increased by injecting into the hot crude coke oven gas an $O_2$-containing gas, and thereby producing a partial combustion of the coke oven gas. The $O_2$-containing gas may include oxygen, oxygen enriched air, or an oxygen-containing gas mixture. The $O_2$-containing gas is preferably injected into the coke oven gas immediately after the discharge thereof from the coke ovens, without any substantial preliminary conveying operation. Further, in situations where the coke oven gas must be conveyed through a relatively lengthy conveyance path to the desired position of utilization, the $O_2$-containing gas may be injected into the coke oven gases at plural positions between the coke ovens and the position of utilization.

In accordance with a further feature of the above embodiment of the present invention, the $O_2$-containing gas is injected into the coke oven gas in a quantity such that, while the temperature of the coke oven gas is increased by an amount sufficient to prevent condensation of higher hydrocarbons, the temperature of the coke oven gas is not increased to a temperature which would allow thermal cracking of the coke oven gas. In this embodiment, the temperature of the coke oven gas is increased to approximately from 800° to 850° C.

In accordance with a further embodiment of the present invention, used in conjunction with the arrangement of the above-noted German patent application, wherein the coke oven gas is subjected to a thermal cracking operation by passing the coke oven gas into a thermal cracking reactor and therein cracking the coke oven gas to form a cracked gas, the $O_2$-containing gas is injected into the coke oven gas, prior to the passage thereof into the thermal cracking reactor, in a quantity such that the temperature of the coke oven gas is raised to the reaction temperature of the cracking operation. This temperature is approximately from 950° to 1500° C.

In accordance with an even further embodiment of the present invention, also used in conjunction with the above-noted cracking operation, the cracking operation is performed directly and immediately after discharge of the coke oven gas from the coke ovens, without any other preliminary conveying operation, and the temperature of the coke oven gas is increased by introducing the $O_2$-containing gas into the thermal cracking reactor, and thereby preventing condensation of higher hydrocarbons while simultaneously cracking the coke oven gas.

In accordance with a somewhat modified embodiment of the present invention, also used in conjunction with the arrangement of the above-noted German patent application, wherein the coke oven gas is passed into a thermal cracking reactor and therein cracked to form a cracked gas, the temperature of the coke oven gas is increased to a temperature sufficient to prevent condensation of higher hydrocarbons by passing the coke oven gas through a heat exchanger in indirect heat exchange relationship with the cracked gas. In this embodiment of the present invention, it will be apparent that the coke oven gas is increased to a temperature which is insufficient to allow thermal cracking of the coke oven gas prior to introduction thereof into the thermal cracking reactor. It will further be apparent that in this embodiment of the present invention the indirect heat exchange between the coke oven gas and the cracked gas is carried out as soon as possible after the discharge of the coke oven gas from the coke ovens, i.e. without any substantial preliminary conveying operation.

BRIEF DESCRIPTION OF THE DRAWINGS

Other objects, features and advantages of the present invention will be apparent from the following detailed description, taken with the accompanying drawings, wherein.

DETAILED DESCRIPTION OF THE INVENTION

Figure 1:
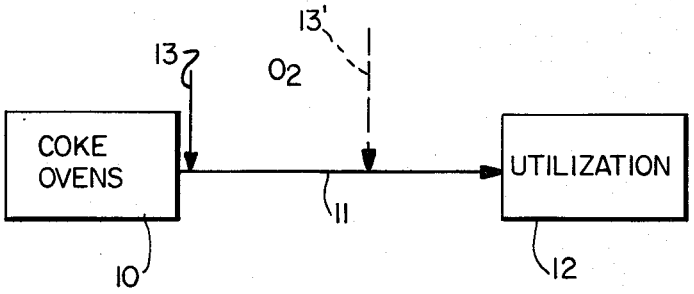
FIG. 1 is a schematic diagram illustrating a first embodiment of the process of the present invention.

With reference now to FIG. 1 of the drawings, a first embodiment of the process of the present invention will be described. A hot, crude coke oven gas is discharged from coke ovens 10 and is conveyed, as indicated at 11, to a position of utilization 12. The temperature of the coke oven gas upon discharge from coke ovens 10 is approximately 750° C., and depending upon the length of path 11, this temperature will normally drop. Such conditions allow for the condensation from the coke oven gas of higher hydrocarbons, and this is disadvantageous.

In accordance with the present invention however, such condensation of higher hydrocarbons is prevented by increasing the temperature of the coke oven gas, at a position as close as possible to the discharge from the coke ovens, to a temperature such that condensation of higher hydrocarbons is prevented. In accordance with the embodiment of the present invention illustrated in FIG. 1, this increase in temperature is achieved by injecting into the coke oven gas an $O_2$-containing gas, as at 13, to thereby produce a partial combustion of the coke oven gas, thus increasing the temperature of the coke oven gas and thereby preventing condensation of higher hydrocarbons.

It of course will be understood by those skilled in the art who are readily aware of the composition of coke oven gas, the compositions of various higher hydrocarbons which are potentially subject to condensation within the parameters of the present discussion.

In further accordance with the embodiment of the invention illustrated in FIG. 1, the $O_2$-containing gas is injected into the coke oven gas in quantities which are insufficient to increase the temperature of the coke oven gas to such a degree that thermal cracking of the coke oven gas would occur. More particularly, in accordance with the embodiment of FIG. 1, the temperature of the coke oven gas is increased to approximately 800° to 850° C.

In accordance with the present invention the $O_2$-containing gas may be oxygen, oxygen enriched air, or an oxygen-containing gas mixture. It is believed that those skilled in the art will readily understand what mixtures of oxygen-containing gas may be added to the coke oven gas to achieve a partial combustion thereof.

The $O_2$-containing gas is preferably introduced into the coke oven gas immediately after the discharge thereof from the coke ovens, without any substantial preliminary conveying operation. This procedure makes it possible to thereby prevent any preliminary cooling of the coke oven gas which would potentially result in condensation of higher hydrocarbons.

In further accordance with the present invention, when the path of conveyance 11 between the coke ovens 10 and the position of utilization 12 is particularly long, the $O_2$-containing gas may be injected into the coke oven gas at several positions along the conveyance path, to thereby avoid any substantial cooling of the coke oven gas after an initial partial combustion thereof. In FIG. 1 this is illustrated by a two-stage injection of $O_2$-containing gas, i.e. at positions 13 and 13'. It is to be understood however that more than two such injection positions could be provided.

By the above described arrangement of FIG. 1, $O_2$-containing gas is injected into the coke oven gas in quantities sufficient to achieve a partial combustion of the coke oven gas to thereby increase the temperature thereof to prevent condensation of higher hydrocarbons. However, the temperature of the coke oven gas is maintained at a level insufficient to allow thermal cracking of the coke oven gas.

Figure 2:
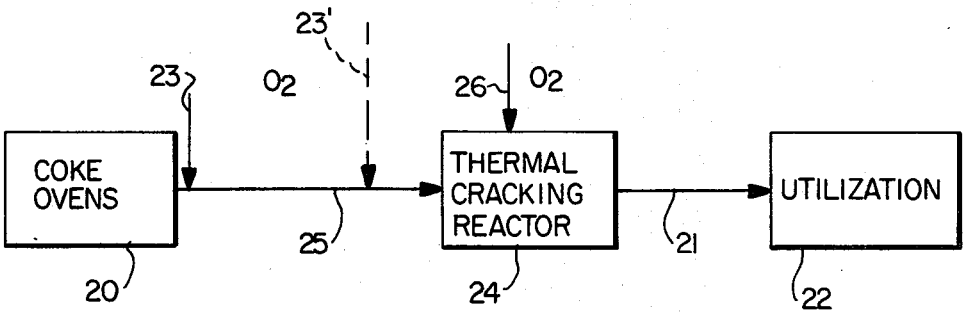
FIG. 2 is a schematic diagram illustrating a second embodiment of the process of the present invention.

With reference now to FIG. 2 of the drawings, a second embodiment of the present invention will be described. This embodiment is employed in connection with the arrangement of the above-discussed German patent application, corresponding to U.S. application Ser. No. 827,809, filed Aug. 25, 1977, i.e. wherein the coke oven gas is introduced into a thermal cracking reactor 24, and $O_2$-containing gas is added thereto, as at 26, to result in a partial combustion of the coke oven gas sufficient to increase the temperature thereof to result in a thermal cracking of the coke oven gas. This operation produces a cracked gas 21 which may then be conveyed to a position of utilization 22.

This embodiment is similar to the embodiment of FIG. 1, in that $O_2$-containing gas is introduced into the coke oven gas at one or more positions, as indicated by 23 and 23', as necessary, along a path of conveyance 25 between coke ovens 20 and thermal cracking reactor 24. However, in this embodiment of the present invention, sufficient $O_2$-containing gas is introduced into the coke oven gas to raise the temperature of the coke oven gas to the reaction temperature of the cracking operation within reactor 24. This temperature is approximately from 950° to 1500° C. As is the case in the previously discussed embodiment, the $O_2$-containing gas is preferably injected into the coke oven gas immediately after the discharge thereof from the coke ovens, without any substantial preliminary conveying operation.

Figure 3:
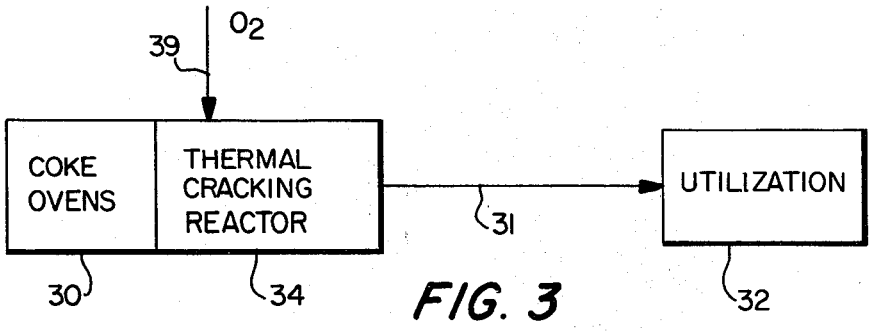
FIG. 3 is a schematic diagram illustrating a third embodiment of the process of the present invention.

With reference now to FIG. 3 of the drawings, a third embodiment of the present invention, which is somewhat of a modification of the embodiment of FIG. 2, will be described.

In the embodiment of FIG. 3, the thermal cracking reactor 34 is located immediately and directly at the discharge of the coke ovens 30. Therefore, the coke oven gas is directly and immediately discharged from the coke ovens 30 into the thermal cracking reactor 34, without any other preliminary conveying operation. Further in the embodiment of FIG. 3, there is only a single injection of $O_2$-containing gas, as indicated at 39, rather than the two injections in the embodiment of FIG. 2. That is, in the embodiment of FIG. 2, a first injection 23 (23') is made to increase the temperature of the coke oven gas within conveyance 25 to the reaction temperature of the reactor, and then after the coke oven gas is introduced into the reactor, a second injection 26 is added to carry out the cracking operation. However, in accordance with the embodiment of FIG. 3 of the drawings, the single injection 39 of $O_2$-containing gas increases the temperature of the coke oven gas, thereby preventing condensation of higher hydrocarbons, while simultaneously cracking the coke oven gas.

In all of the above embodiments of the present invention, the temperature of the coke oven gas is increased by injecting therein quantities of $O_2$-containing gas. However, in accordance with the embodiment of FIG. 4, the temperature of the coke oven gas may be increased to avoid the condensation of higher hydrocarbons by other means.

Figure 4:
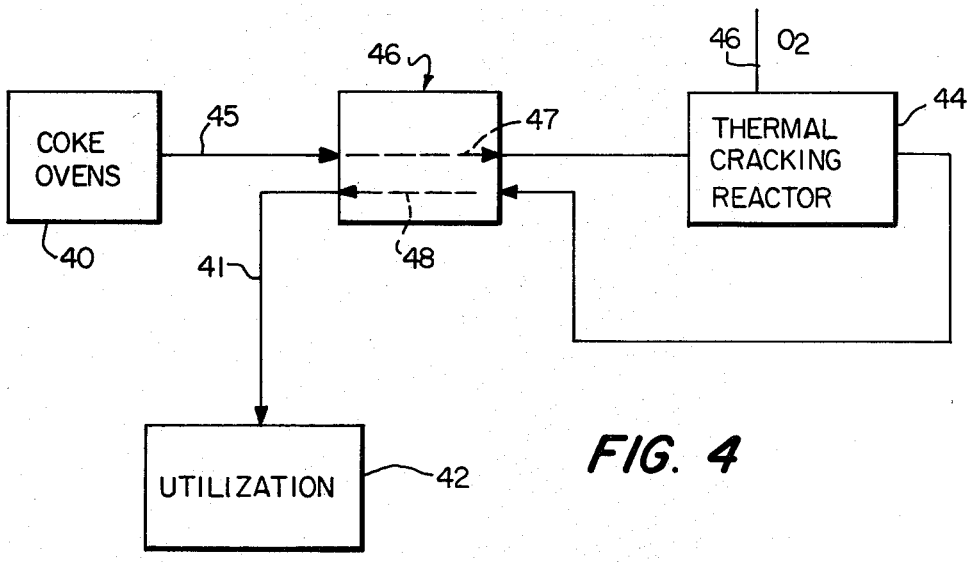
FIG. 4 is a schematic diagram illustrating a fourth embodiment of the process of the present invention.

Specifically, in the arrangement of FIG. 4 the coke oven gas is discharged from coke ovens 40 and passes via conveyance 45 through a first passage 47, for example an inner tube, of an indirect heat exchanger 46. The coke oven gas is then passed into thermal cracking reactor 44, and $O_2$-containing gas is added as at 46 to create cracked gas 41. The cracked gas 41 is then passed through a second passage 48, for example an outer tube, of heat exchanger 46, and then to a position of utillization 42. In accordance with this arrangement of the present invention the hot crude coke oven gas is passed in indirect heat exchange relation with the hotter cracked gas. The coke oven gas is thereby heated by the cracked gas to a temperature such that condensation of higher hydrocarbons is prevented. As in all embodiments of the present invention, it is desirable to raise the temperature of the coke oven gas as soon as possible after discharge thereof from the coke ovens.

Although the present invention has been described above in detail with reference to particular preferred embodiments, it is to be understood that various modifications may be made to the above specifically described features without departing from the scope of the present invention.

What we claim is:

1. A process for conveying and treating hot, crude coke oven gas from coke ovens, said process comprising:

discharging hot, crude coke oven gas directly from coke ovens into a conveying means;

conveying said hot, crude coke oven gas through said conveying means, without any preliminary cooling or purification operations, to a thermal cracking reactor;

injecting a first quantity of $O_2$-containing gas into said coke oven gas within said thermal cracking reactor and thereby thermally cracking said coke oven gas to form a cracked gas;

injecting a second quantity of $O_2$-containing gas into said coke oven gas within said conveying means, thereby producing a partial combustion of said coke oven gas within said conveying means, and increasing the temperature of said coke oven gas within said conveying means to the reaction temperature of the thermal cracking operation within said thermal cracking reactor, thereby preventing the condensation of higher hydrocarbons from said coke oven gas within said conveying means; and passing said cracked gas from said thermal cracking reactor to a position of utilization.

2. A process as claimed in claim 1, wherein said second quantity of $O_2$-containing gas comprises oxygen.

3. A process as claimed in claim 1, wherein said second quantity of $O_2$-containing gas comprises oxygen enriched air.

4. A process as claimed in claim 1, wherein said second quantity of $O_2$-containing gas comprises an oxygen-containing gas mixture.

5. A process as claimed in claim 1, wherein said second quantity of $O_2$-containing gas is injected into said coke oven gas within said conveying means immediately after the discharge thereof from said coke ovens, without any substantial preliminary conveying operation.

6. A process as claimed in claim 1, wherein said second quantity of $O_2$-containing gas is injected into said coke oven gas at plural positions of said conveying means between said coke ovens and said thermal cracking reactor.

7. A process as claimed in claim 1, wherein said temperature is approximately from 950° to 1500° C.

* * * * *